US007717419B2

(12) United States Patent
Allen, Jr. et al.

(10) Patent No.: US 7,717,419 B2
(45) Date of Patent: May 18, 2010

(54) ACCUMULATOR HAVING ROTARY DRIVE

(75) Inventors: Clarence Allen, Jr., Mt. Crawford, VA (US); Michael Lippy, Herndon, VA (US); Sharon L. Myers, Weyers Cave, VA (US)

(73) Assignee: A. G. Stacker Inc., Weyers Cave, VA (US)

( * ) Notice: Subject to any disclaimer, the term of this patent is extended or adjusted under 35 U.S.C. 154(b) by 95 days.

(21) Appl. No.: 12/057,715

(22) Filed: Mar. 28, 2008

(65) Prior Publication Data

US 2008/0258376 A1 Oct. 23, 2008

Related U.S. Application Data

(60) Provisional application No. 60/908,585, filed on Mar. 28, 2007.

(51) Int. Cl.
*B65H 31/32* (2006.01)

(52) U.S. Cl. ..... 271/189; 271/218

(58) Field of Classification Search ..... 271/201, 271/189, 218; 414/790.8

See application file for complete search history.

(56) References Cited

U.S. PATENT DOCUMENTS

| | | | | |
|---|---|---|---|---|
| 3,593,860 | A * | 7/1971 | Brenner | 414/793.5 |
| 5,110,112 | A * | 5/1992 | Henn et al. | 271/189 |
| 5,131,647 | A * | 7/1992 | Henn et al. | 271/189 |
| 6,394,741 | B1 * | 5/2002 | Lehtimaki | 414/790.8 |
| 7,404,556 | B2 * | 7/2008 | Allen et al. | 271/201 |

* cited by examiner

*Primary Examiner*—Kaitlin S Joerger
(74) *Attorney, Agent, or Firm*—Muncy, Geissler, Olds & Lowe, PLLC

(57) ABSTRACT

A sheet stacking device includes a support frame, a conveyor and an accumulator at a discharge end of the conveyor, the accumulator having a plurality of elongate fingers, at least one of which includes a rack having teeth along a first side, a rotatable drive shaft extending in a width direction of the conveyor, a gear having teeth mounted on the drive shaft and operatively engaging the rack teeth, and a rotary actuator operably connected to the drive shaft, the rotary actuator rotating said drive shaft in a first and second directions to move an end of the elongate fingers toward and away from the conveyor discharge end of the conveyor. Also a method of operating the device.

17 Claims, 7 Drawing Sheets

ACCUMULATOR HAVING ROTARY DRIVE

CROSS REFERENCE TO RELATED APPLICATIONS

The present application claims the benefit of U.S. Provisional Patent Application No. 60/908,585, filed Mar. 28, 2007, the entire contents of which is hereby incorporated by reference.

BACKGROUND OF THE INVENTION

1. Field of Invention

The present invention is directed to an apparatus for stacking sheets of material that includes an accumulator and to a method for using the apparatus. More specifically, the present invention is directed to an apparatus for stacking sheets of material that includes an accumulator system with a rotary drive and to a method of using the apparatus.

2. Description of Related Art

Devices for stacking sheets of material, such as sheets of corrugated material, are well known. One example of a commercially available device is the AGS2000 Rotary Die Cut Stacker made by the assignee of the present invention, A.G. Stacker, Inc., Weyers Cave, Va. Further examples of such devices are disclosed in U.S. Pat. Nos. 3,321,202 to Martin and 3,419,266 to Martin, each of which is expressly incorporated by reference in its entirety.

FIGS. 1-4 illustrate a conventional apparatus for stacking corrugated blanks. As illustrated therein, a stacking machine 100 typically comprises a layboy section 102 which receives corrugated blanks, such as those produced by a rotary die cut machine 101, and discharges the corrugated blanks onto a transfer conveyor 104. The transfer conveyor 104 receives the blanks and transports them to a main conveyor 106. The main conveyor 106 has an intake end 108 and a discharge end 110. At its intake end 108, the main conveyor 106 is mounted to a base 112 at a pivot point 114 so that the conveyor may be pivoted to raise the discharge end 110 of the conveyor 106. At the discharge end 110 of the conveyor 106, an accumulator section 116 is controllable to selectively receive discharged blanks or to allow the discharged blanks to fall to the ground or another conveyor to form a stack.

In operation, the main conveyor 106 is pivoted about the pivot point 114 to lower the discharge end 110 of the conveyor to an initial position (the position illustrated in FIG. 2). Sheets of material (not illustrated) exit the die cutter 101 and are fed onto the main conveyor 106 at intake end 108, transported along the length of the main conveyor 106 to discharge end 110, and discharged from the main conveyor 106. As they are discharged, the sheets often strike a backstop 118 in the accumulator section 116 that stops the forward momentum of the sheets. The sheets settle down, typically onto a discharge conveyor (not illustrated), to form a stack of sheets (not illustrated). As additional sheets drop onto the top of the stack, the stack grows in height, and main conveyor 106 is pivoted to raise the discharge end 110 to a position higher than the top of the growing stack. FIG. 3 illustrates main conveyor 106 in the raised position.

Once a stack of sheets has reached a desired height, it is removed, and the process of forming an additional stack begins. However, to permit time to remove a finished stack without stopping main conveyor 106, accumulator section 116 is employed. Accumulator section 116 catches or accumulates a small stack of sheets as main conveyor 106 continues to operate so that the completed stack on the discharge conveyor can be removed. When the completed stack is removed, the main conveyor is returned to the lowered position illustrated in FIG. 2, the small stack on the accumulator is dropped onto the transfer conveyor, and additional sheets are added to the top of this new stack.

The accumulator section 116 includes a plurality of catcher elements 120. Catcher elements 120 include a first catching member 122 and a plurality of extending members 124. When the catcher elements 120 are activated, the first catching member 122 is rotated into the position shown in FIG. 2. The extending members 124 are moved from the retracted position shown in FIG. 2 into an extended position where they extend at least partially across the bottom of the accumulator section 116 to catch sheets exiting the main conveyor 106. After the stack below the accumulator section 116 has been removed, the extending members 124 are retracted to drop the partial stack being formed thereon onto a discharge conveyor.

Existing accumulator designs are complex and generally require considerable manufacturing labor. As illustrated in FIG. 4, a conventional accumulator includes an air cylinder 132 having a projecting rod 134 extending perpendicularly to the direction of travel of the main conveyor 106, which rod drives a bar 136. The bar 136 is connected to a gear rack 138 extending transversely across the width of the main conveyor 106. The gear rack 138 engages a plurality of horizontally disposed large pinion gears 140 on pinion shafts 142 which pinion shafts 142 also each support a small pinion gear 144 (the pinions and pinion shafts are enclosed in housings that are not shown). The small pinion gears 144, in turn, engage rack teeth 146 on the sides of the extending members 124 and cause the extending members to extend and retract when the small pinion gears 144 rotate.

The gear ratio between the diameter of the large pinion gears 140 and small pinion gears 144 is selected to allow the eight inch travel of a typical air cylinder rod 134 to move the extending members a distance of about 20 inches. With this arrangement, linear motion must be converted to rotary motion, the rotary motion must be amplified with a selected gear ratio, and the rotary motion must be reconverted to linear motion to operate the accumulator. This arrangement is not only relatively expensive to manufacture, but in addition, the air cylinder may limit the accuracy with which the extending members 124 can be positioned.

There have been other attempts to address the problem of sufficient velocity control and position control in conventional systems. For example, U.S. Pat. No. 6,042,108 to Morgan discloses a flexible curtain which is extended into the stream of sheets. The disclosed flexible curtain system is complex with many moving parts and increases both material and manufacturing costs. Accordingly, it would be desirable to provide an improved accumulator system for a sheet stacking device.

SUMMARY OF THE INVENTION

These and other problems are addressed by embodiments of the present invention, a first aspect of which comprises a sheet stacking device that includes a support frame and a conveyor pivotably connected to the support frame that has an intake end and a discharge end. The conveyor carries sheets of material from an upstream location near the intake end to a downstream location near the discharge end. An accumulator is provided at the discharge end and includes a plurality of elongate fingers; at least one of the plurality of elongate fingers includes a rack having teeth along a first side. A rotatable drive shaft extends in the width direction of the conveyor, and a gear having teeth is mounted on the drive shaft with at least one of the gear teeth projecting into a space between adjacent ones of the rack teeth. A rotary actuator is operably connected to the drive shaft, the rotary actuator rotating the drive shaft in a first direction to move the outer end of the at least one of the plurality of elongate fingers away from the conveyor discharge end and in a second direction to move the outer end of the at least one of the plurality of elongate fingers toward the discharge end.

Another aspect of the invention comprises a sheet stacking device that includes a support frame and a conveyor having an intake end pivotably connected to the support frame and a discharge end. The conveyor is configured to carry sheets of material in a direction of travel from an upstream location near the intake end to a downstream position near the discharge end, and an accumulator is mounted at the discharge end. The accumulator includes a plurality of housings, each of the housings having an interior and a channel having a channel bottom, at least some of the channel bottoms including an opening. A plurality of elongate fingers extend through and are slidably supported by the channels. A first set of the plurality of elongate fingers has a first surface having a gear rack bounded by first and second planar surface portions. A rotatable drive shaft extends through the plurality of housings in the width direction of the conveyor, and a plurality of gears are mounted on the drive shaft. Each of the plurality of gears extends through an opening in one of the channel bottoms and has teeth engaging the rack teeth of one of the elongate fingers. The sheet stacking apparatus also includes a rotary actuator operably connected to the drive shaft, the rotary actuator rotating the drive shaft in a first direction to move the outer ends of the elongate fingers away from the conveyor discharge end and in a second direction to move the outer ends of the elongate fingers toward the discharge end.

An additional aspect of the invention comprises a method that is practiced with a sheet stacking device comprising a support frame, a conveyor having an intake end pivotably connected to the support frame and a discharge end. The sheet stacking device also includes an accumulator mounted at the discharge end, the accumulator comprising a plurality of elongate fingers and having rack teeth along a first side thereof. A rotatable drive shaft extends under the plurality of elongate fingers and has drive gears engaging the rack teeth and rotary actuator is operably connected to the drive shaft. The method includes steps of operating the conveyor to transport sheets of material along the conveyor in a direction from said intake end toward said discharge end and dropping the sheets to form a primary stack adjacent the discharge end, and raising the discharge end to maintain the discharge end at an elevation greater than a height of the primary stack. The method further includes controlling the rotary actuator to turn the drive shaft and the gears mounted on the drive shaft to extend the outer ends of the plurality of fingers away from the discharge end of the conveyor and into the path of sheets of material exiting the discharge end of the conveyor, forming a secondary stack on the plurality of fingers, moving the primary stack away from the sheet stacking device, and controlling the rotary actuator to turn the drive shaft and gears mounted on the drive shaft to move the outer ends of the plurality of fingers toward the discharge end of the conveyor to drop the secondary stack.

BRIEF DESCRIPTION OF THE DRAWINGS

The above and other aspects of embodiments of the present invention will be more apparent from the following description taken in conjunction with the accompanying drawings, in which.

DETAILED DESCRIPTION

Figure 1:
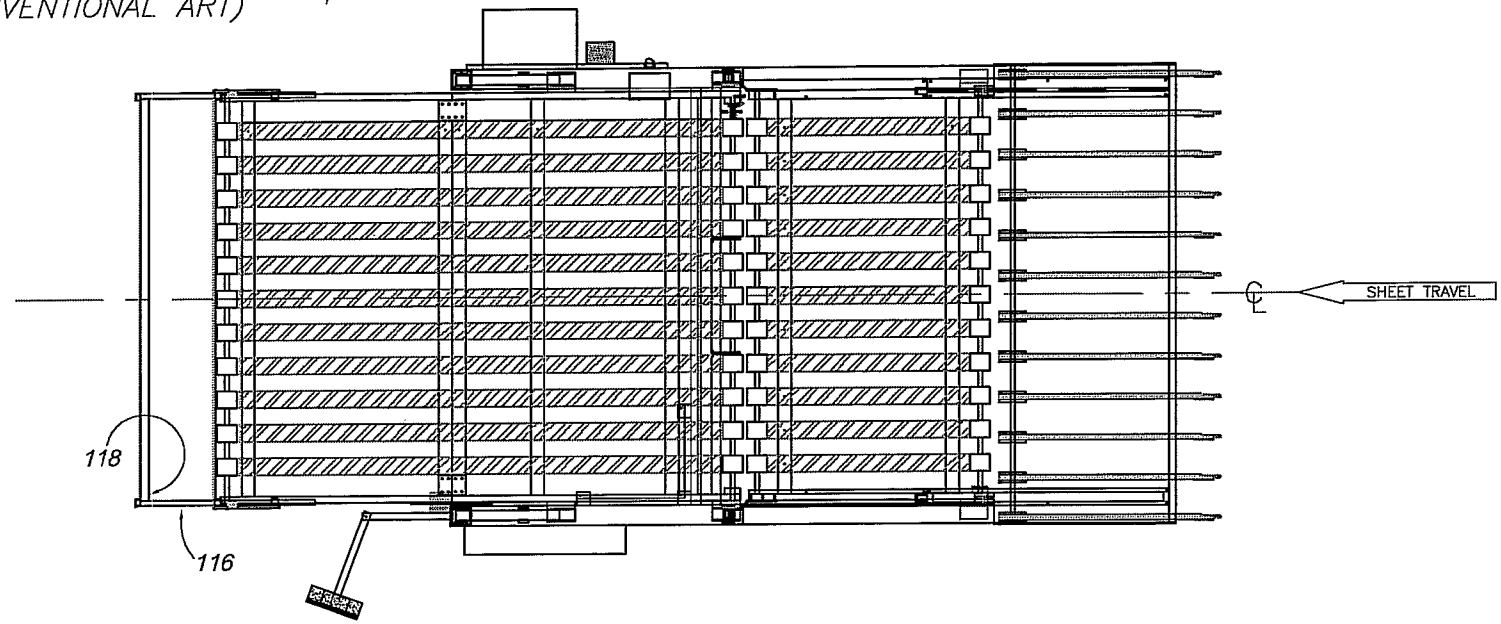
FIG. 1 (CONVENTIONAL ART)
FIG. 1 is a top plan view of a conventional sheet stacking device having a main conveyor and an accumulator section.
Figure 2:
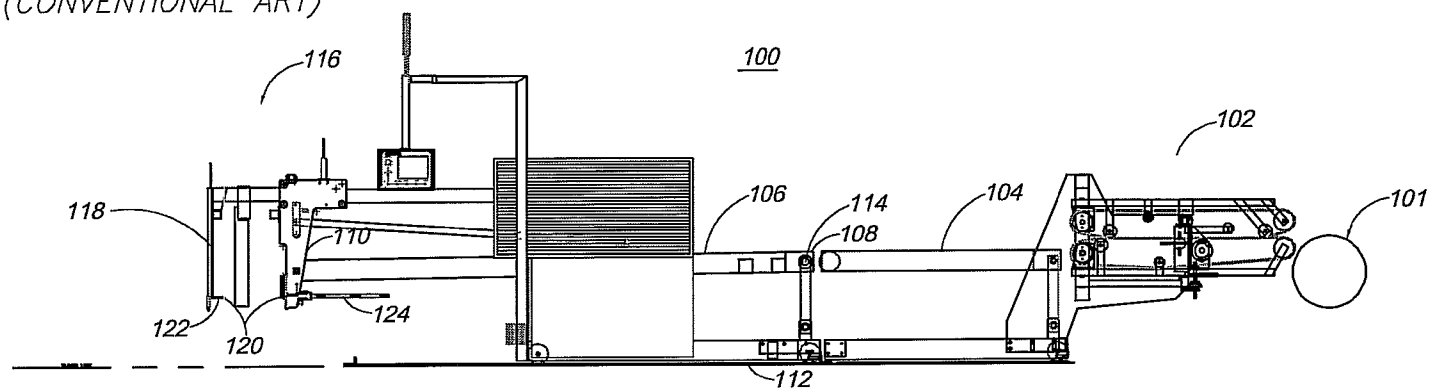
FIG. 2 (CONVENTIONAL ART)
FIG. 2 is a side elevational view of the sheet stacking device of FIG. 1 with the main conveyer section in a lowered position.
Figure 3:
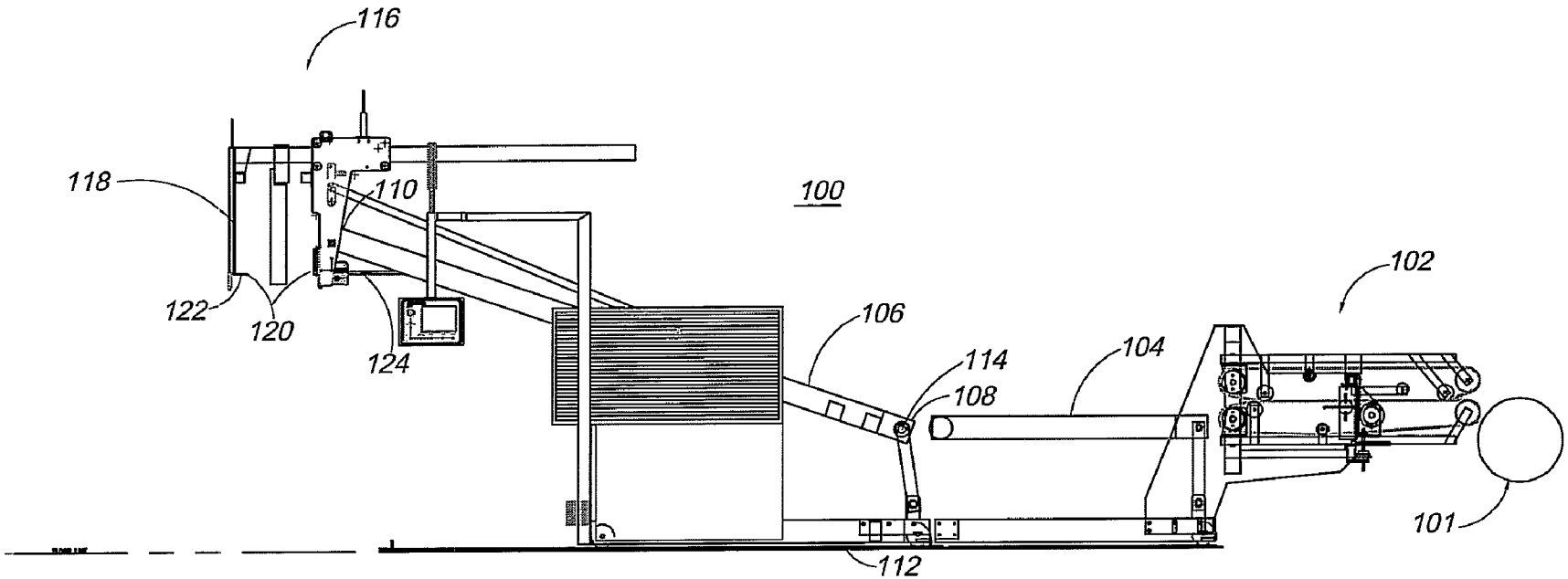
FIG. 3 (CONVENTIONAL ART)
FIG. 3 is a side elevational view of the sheet stacking device of FIG. 1 with the main conveyor in a raised position.
Figure 4:
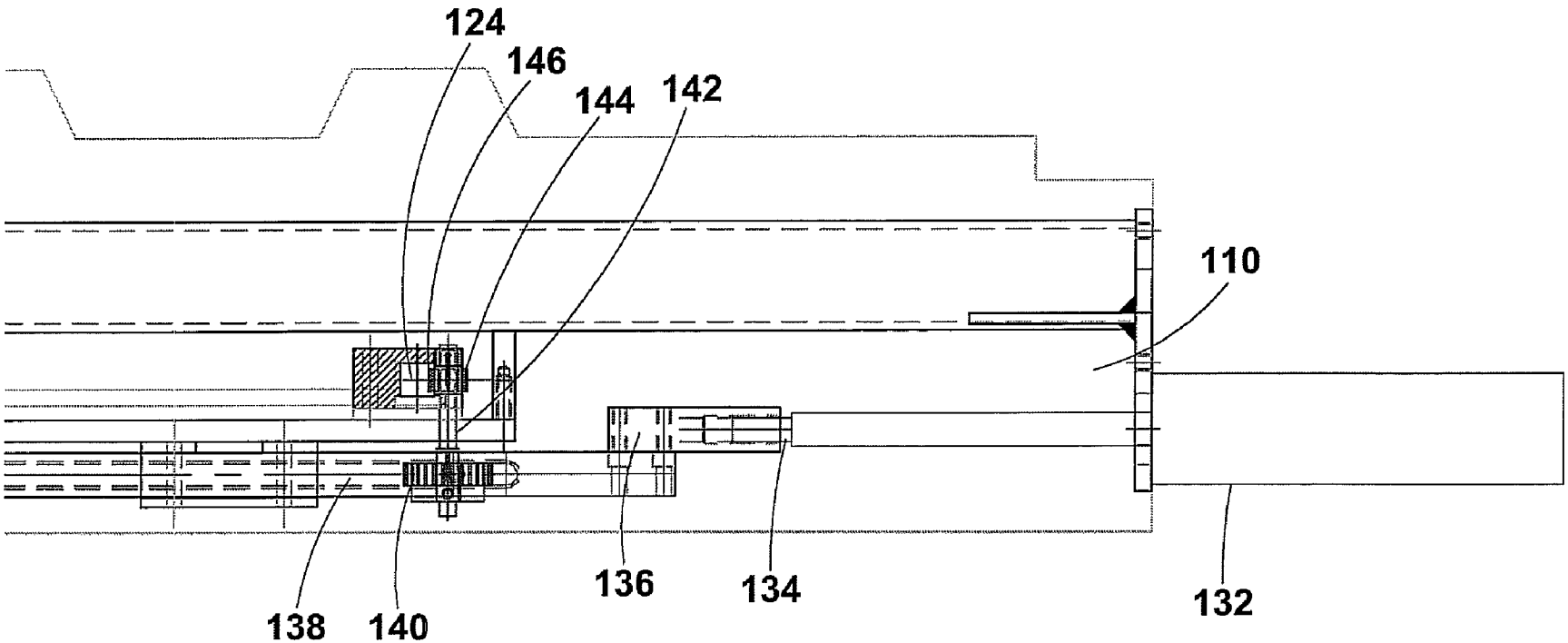
FIG. 4 is a front elevational view of a portion of the accumulator section of the sheet stacking device of FIG. 1.
Figure 5:
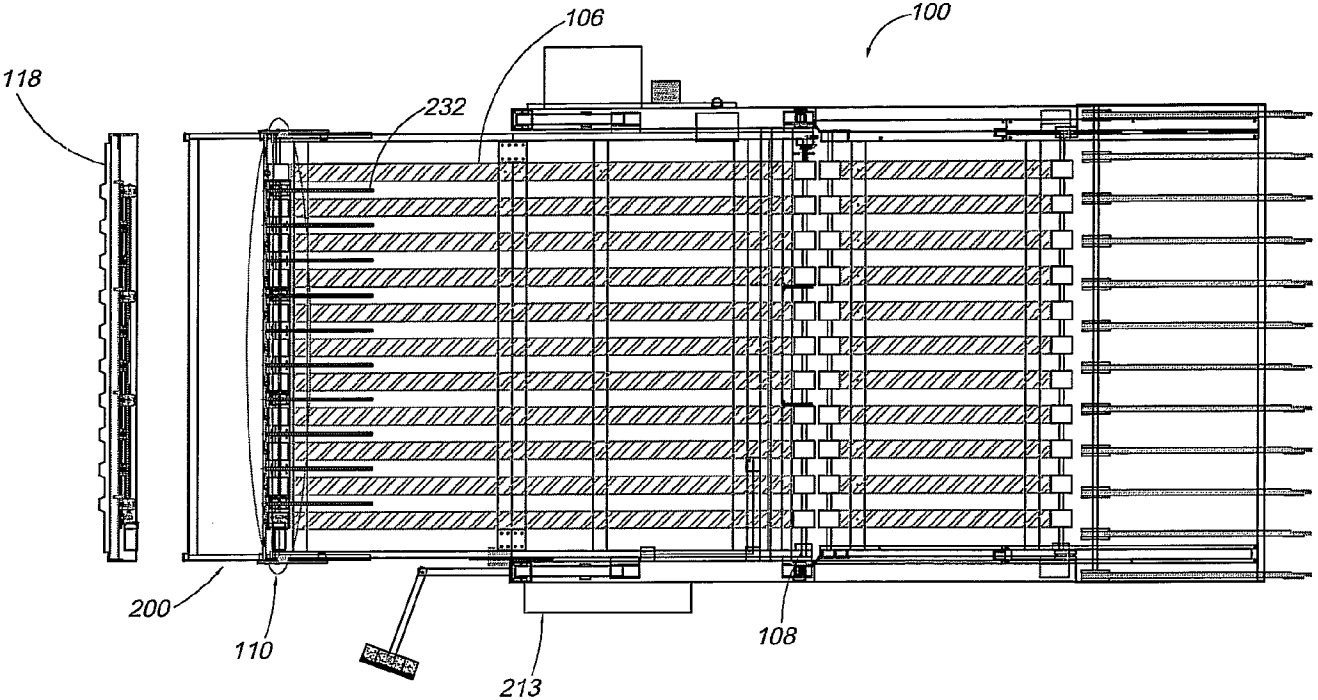
FIG. 5 is a top plan view of a sheet stacking device according to an embodiment of the present invention having a main conveyor and an accumulator.
Figure 6:
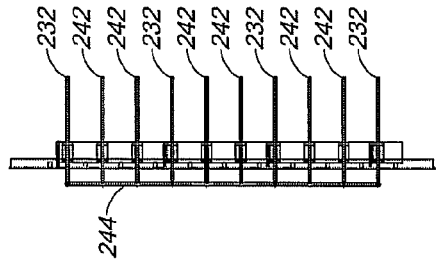
FIG. 6 is a top plan view of a portion of the accumulator of the device of FIG. 5 isolated from the stacking device for illustration purposes.
Figure 8:
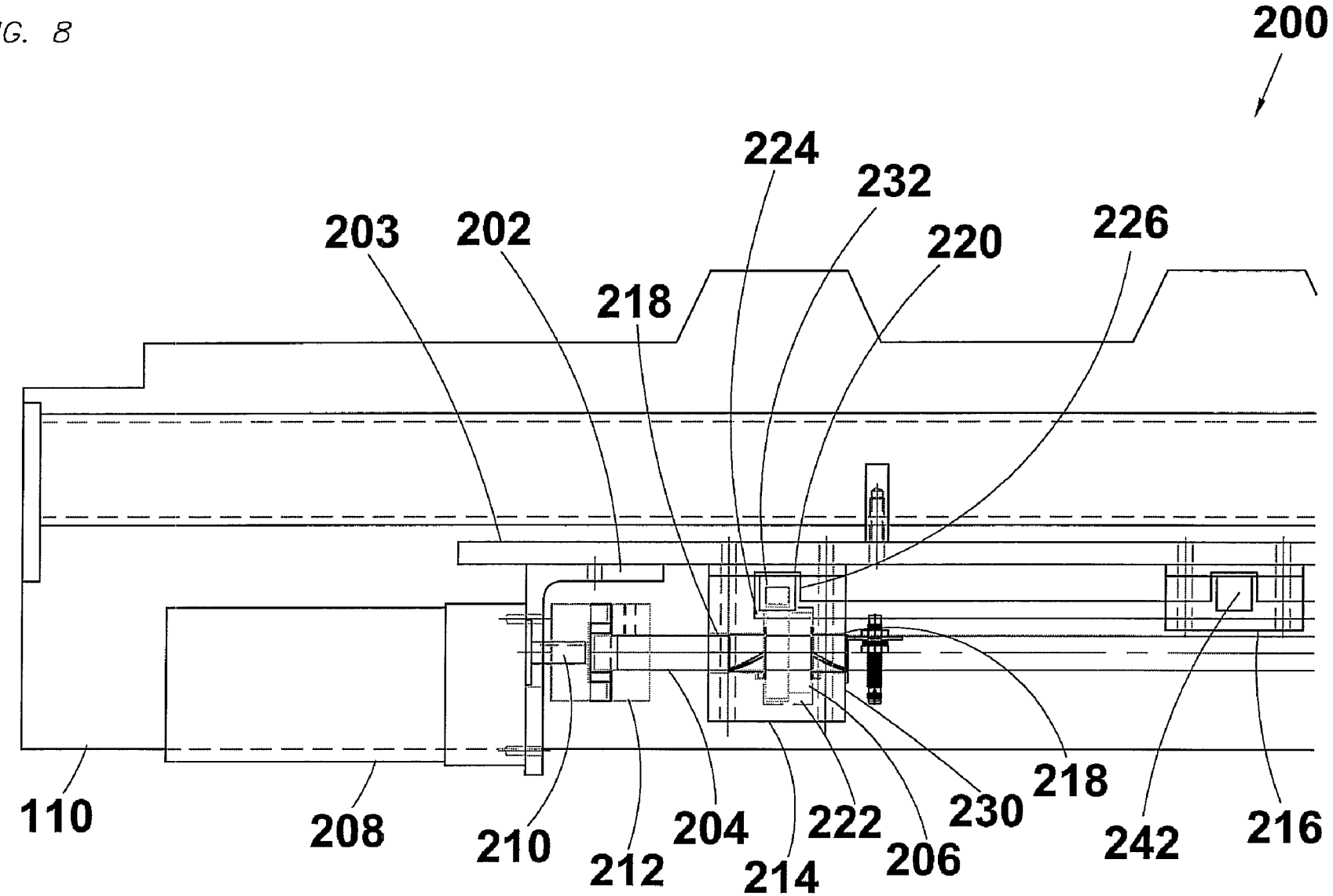
FIG. 8 is a front elevational view of a portion of the accumulator of FIG. 5.
Figure 9:
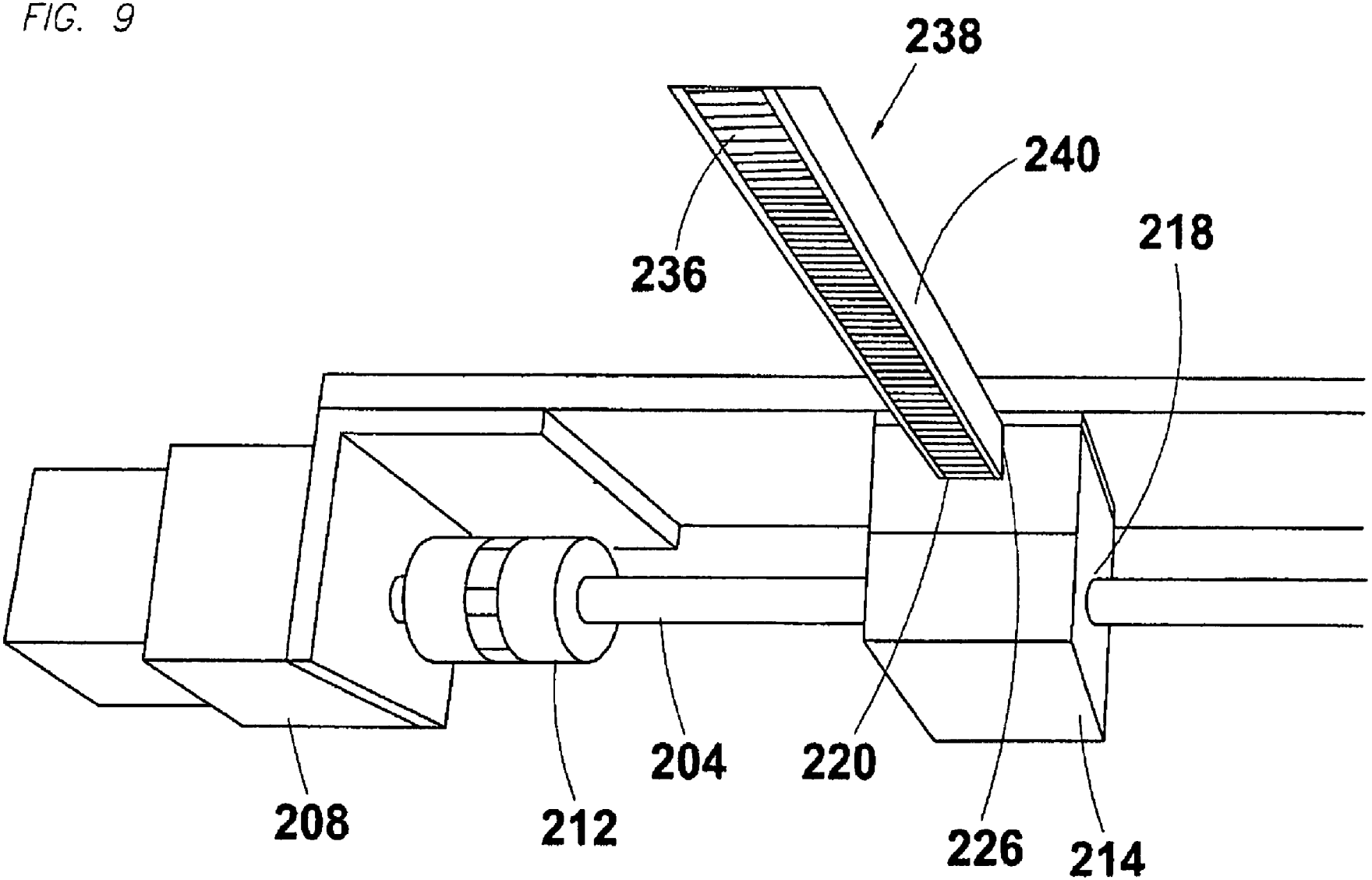
FIG. 9 is a perspective view of a portion of the accumulator of FIG. 5.

Referring now to the drawings, wherein the showings are provided for purposes of illustrating a presently preferred embodiment of the invention only, and not for the purpose of limiting same, FIG. 5 illustrates the discharge end 110 of stacking apparatus 100 equipped with a novel accumulator 200. With reference to FIG. 8, accumulator 200 comprises first and second angled brackets 202 (only one of which is illustrated) depending from a support plate 203 mounted near the discharge end 110 of main conveyor 106 below the end of the conveyor 106. The angled brackets 202 support a drive shaft 204 having a plurality of pinion gears 206 mounted at intervals therealong and keyed to drive shaft 204 so as to rotate therewith. A rotary actuator such as electric motor 208, which may comprise, for example, an electric stepper motor, is mounted to one of the angled brackets 202, and a rotor shaft 210 of the motor 208 is coupled to drive shaft 204 with a coupling assembly 212. A controller 213 is operatively connected to, electric motor 208 to cause motor 208 to rotate in first and second direction to turn drive shaft 204 in first and second directions for reasons discussed further hereinbelow.

Figure 7:
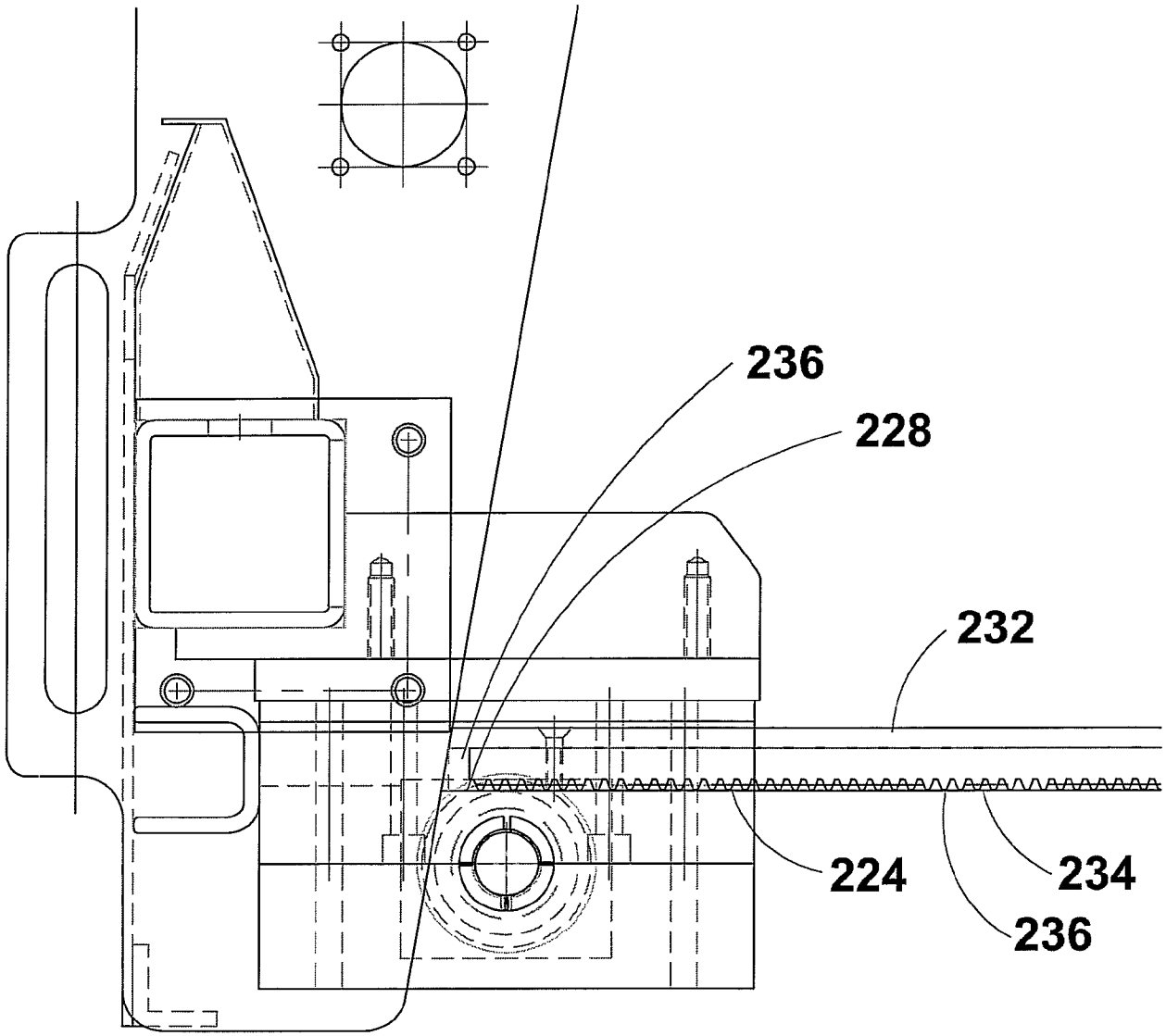
FIG. 7 is a side elevational view, partly in section, of the accumulator of FIG. 5.

A plurality of drive housings 214 and idler housings 216 are secured to the underside of support plate 204 between angled brackets 202 each of which housings 214, 216 includes transversely spaced openings 218 for receiving the drive shaft 204 and a longitudinal opening 220 (with respect to the operating direction of main conveyor 106) for receiving a finger member as discussed below. Drive housings 214 include an interior 222 to accommodate the pinion gears 206. Longitudinal openings 220 may be referred to as channels and include a channel bottom wall 224 and opposed channel side walls 226. The longitudinal openings 220 of drive housings 214 also include an opening 228 (illustrated in FIG. 7) in channel bottom wall 224.

The drive housings 214 and idler housings 216 may be formed in two or more pieces to facilitate assembly and may be formed from a material having good wear resistance and machinablility. Suitable materials include DELRIN, sold by E.I. DuPont de Nemours & Company, and ACETRON and NYLATRON, both available from Quadrant Engineering Plastic Products. NYLATRON is presently preferred for this application. Polymer bearings 230 may be included in the housing interior 222 to provide additional wear resistance between the pinion gears 206 and drive housing 214. Suitable polymer bearings 230 are available from Igus Inc. of East Providence, R.I.

Referring now to FIGS. 5-8, first finger members 232 comprise elongated and generally rectangular rods having a gear rack 234 including a plurality of teeth 236 formed along one side 238 thereof. The gear rack 234 is bounded by first and second planar edge portions 240 in which no teeth are present. The teeth 236 do not project beyond the planar edge portions 240. First finger members 236 are slidably mounted in longitudinal openings 220 of drive housings 214 with first side 238 slidably supported by channel bottom wall 224 and the opposite sides of drive finger member 232 guided by channel side walls 226. A pinion gear 206 extends from interior 222 through opening 238 and into longitudinal opening 220 and engages gear rack 234.

Accumulator 200 also includes a plurality of second finger members 242 which are generally similar in size and shape to first finger members 232 but second finger members 242 do not include a gear rack. Second finger member 242 are slidably received in idler housings 216 wherein they are retained transversely but slide freely in a longitudinal direction. A tie rod 244 connects the second finger members 242 to the first finger members 232 so that movement of the first finger members also causes the second finger members to move. The relative number of first and second finger members can vary. An accumulator may comprise no second finger members, for example, in which case all first finger members would be directly driven by a pinion gear or an accumulator may include only one first finger member that drives all second finger members via a tie rod. In practice, it is generally preferable to make every second or third finger member a first finger member so that a driving force is applied evenly along the width of the accumulator. The disclosed embodiment includes four driven, first finger members and six second or non directly driven finger members.

In operation, when the stack being formed by conveyor 106 has reached a predetermined height, the controller 213 actuates electric motor 208 to rotate drive shaft 204 in a first direction. Pinion gears 206 keyed to the drive shaft 204 rotate with the drive shaft and engage teeth 236 of gear racks 234 of each first finger member 232 to drive first finger members 232 along longitudinal channels 220 and extend first finger members and any second finger members 242 into the path of descending sheets of material falling off the end of the main conveyor 106. Sheets are accumulated on the extended first and second finger members 232, 242 until a primary stack of sheets (not illustrated) has been removed from the region beneath the discharge end 110 of the main conveyor 106. The discharge end of main conveyor 106 is then lowered and the electric motor 208 is driven to rotate the drive shaft 204 in a second direction to retract first and second fingers 232, 242 and drop the secondary stack of sheets that has accumulated thereon.

As known to those skilled in the relevant art, a stepper motor system is an electro-mechanical rotary actuator that converts electrical pulses into unique shaft rotations. This rotation is directly related to the number of pulses. This provides highly accurate and repeatable velocity and position control. Since the stepper motor converts electrical energy into discrete motions or steps, it can move the accumulator rack and/or extending members to a specified length with enhanced velocity and position control. Once energized, pulses are sent from a drive amplifier to the stepper motor so that the stepper motor is then enabled for precise positioning. The drive or control processor (not shown) controls position, velocity and torque. Suitable drive amplifiers for stepper motors are available from Anaheim Automation Inc. of Anaheim, Calif. The utilization of a rotary actuator, such as a stepper motor or a servo motor, provides accurate position and velocity control.

While the invention has been shown and described with reference to a certain exemplary embodiment, it will be understood by those skilled in the art that various changes in form and details may be made therein without departing from the spirit and scope of the invention. For example, while the present invention has been described with respect to an upstacking style sheet device, it should be understood that it is also applicable to other sheet stacking devices that use accumulators. A proximity sensor may also be provided to sense when the rack is at a certain position, such as a home position and provide a self-correcting component to the system by maintaining the rack location. It is intended that all such changes comprise a part of the present invention to the extent they come within the scope of the several claims appended hereto.

What is claimed is:

1. A sheet stacking device comprising:

a support frame;

a conveyor having an intake end pivotably connected to the support frame and a discharge end, the conveyor having a width and carrying sheets of material in a longitudinal direction of travel from an upstream location near the intake end to a downstream location near the discharge end; and an accumulator at the discharge end;

the accumulator comprising a plurality of elongate fingers each having an outer end, at least one of said plurality of elongate fingers including a rack having teeth along a first side, a rotatable drive shaft having a longitudinal axis extending in the width direction of the conveyor, at least one gear having teeth mounted on said drive shaft and operatively engaging said rack of said at least one of said plurality of elongate fingers, and a rotary actuator operably connected to said drive shaft, said rotary actuator rotating said drive shaft in a first direction to move the outer end of said at least one of said plurality of elongate fingers away from the conveyor discharge end and in a second direction to move the outer end of said at least one of said plurality of elongate fingers toward said discharge end.

2. The sheet stacking device of claim 1 wherein said at least one of said plurality of elongate fingers comprises a plurality of elongate fingers and wherein said at least one gear comprises a plurality of gears.

3. The sheet stacking device of claim 1 wherein said rotary actuator comprises an electric motor.

4. The sheet stacking device of claim 3 wherein said electric motor has a rotor shaft having an axis parallel to said drive shaft longitudinal axis.

5. The sheet stacking device of claim 3 wherein said electric motor has a rotor shaft having an axis coaxial with said rotor shaft axis.

6. The sheet stacking device of claim 1 wherein said accumulator comprises a plurality of channels for slidably supporting the plurality of elongate fingers.

7. The sheet stacking device of claim 6 wherein said channels include a channel bottom and first and second channel sides and wherein at least one of said channel bottoms includes an opening through which said gear mounted on said drive shaft projects while engaging the gear teeth of said at least one of said elongate fingers.

8. The sheet stacking device of claim 7 wherein said first side of said at least one of said elongate fingers comprises first and second planar portions on opposite sides of said rack, said first and second planar portions contacting said channel bottom and slidably supporting said at least one of said elongate fingers on said channel bottom.

9. The sheet stacking device of claim 3 wherein said electric motor comprises a stepper motor.

10. The sheet stacking device of claim 1 wherein said first one of said plurality of elongate fingers is connected to additional ones of said plurality of elongate fingers by a tie bar, whereby movement of said at least one of said plurality of elongate fingers causes movement of additional ones of said plurality of elongate fingers.

11. The sheet stacking device of claim 1 wherein said accumulator comprises a housing having an interior, said drive shaft passes through said housing in a first direction, said at least one of said fingers passes through said housing in a second direction perpendicular to said first direction, and said gear is at least partially disposed in said interior.

12. A sheet stacking device comprising:

a support frame;

a conveyor having an intake end pivotably connected to the support frame and a discharge end, the conveyor having a width and configured to carry sheets of material in a longitudinal direction of travel from an upstream location near the intake end to a downstream position near the discharge end; and an accumulator mounted at the discharge end;

the accumulator comprising:

a plurality of housings, each of said plurality of housings having an interior and a channel having a channel bottom, at least some of said channel bottoms including an opening;

a plurality of elongate fingers each having an outer end, each of said plurality of elongate fingers extending through and being slidably supported by one of said channels;

a first set of said plurality of elongate fingers comprising a first surface having a gear rack bounded by first and second planar surface portions;

a rotatable drive shaft extending through said plurality of housings in the width direction of the conveyor, a plurality of being gears mounted on said drive shaft, each of said plurality of gears extending through an opening in one of the channel bottoms and having teeth engaging the rack teeth of one of the plurality of elongate fingers; and a rotary actuator operably connected to said drive shaft, said rotary actuator rotating said drive shaft in a first direction to move the outer ends of said first set of said plurality of elongate fingers away from the conveyor discharge end and in a second direction to move the outer ends of said first set of said plurality of elongate fingers toward said discharge end.

13. The sheet stacking device of claim 12 wherein said rotary actuator comprises an electric motor.

14. The sheet stacking device of claim 12 comprising a second set of elongate fingers each having a planar, continuous wall engaging one of said channel bottoms.

15. The sheet stacking device of claim 14 including a tie bar connecting said second set of elongate fingers to said first set of elongate fingers.

16. The sheet stacking device of claim 13 wherein said electric motor comprises a stepper motor.

17. In a sheet stacking device comprising a support frame, a conveyor having an intake end pivotably connected to the support frame and a discharge end, and an accumulator mounted at the discharge end, the accumulator comprising a plurality of elongate fingers having an outer end and having rack teeth along a first side thereof, a rotatable drive shaft extending under the plurality of elongate fingers and having drive gears engaging the rack teeth of the plurality of elongate fingers and a rotary actuator operably connected to the drive shaft, a method comprising the steps of:

operating the conveyor to transport sheets of material along the conveyor in a direction from said intake end toward said discharge end and to drop the sheets to form a primary stack adjacent the discharge end;

raising the discharge end to maintain the discharge end at an elevation greater than a height of the primary stack;

controlling the rotary actuator to turn the drive shaft and the gears mounted on the drive shaft to extend the outer ends of the plurality of fingers away from the discharge end of the conveyor and into the path of sheets of material exiting the discharge end of the conveyor;

forming a secondary stack on the plurality of fingers;

moving the primary stack away from the sheet stacking device; and controlling the rotary actuator to turn the drive shaft and gears mounted on the drive shaft to move the outer ends of the plurality of fingers toward the discharge end of the conveyor to drop the secondary stack.

* * * * *